US005122994A

United States Patent [19]

Benedetti

[11] Patent Number: 5,122,994

[45] Date of Patent: Jun. 16, 1992

[54] CLOCK APPARATUS

[76] Inventor: Judy E. Benedetti, 14041 San Pablo Ave. Apt. 328, San Pablo, Calif. 94806

[21] Appl. No.: 610,167

[22] Filed: Nov. 5, 1990

[51] Int. Cl.[5] ..... G04F 1/04

[52] U.S. Cl. ..... 368/93; 368/10

[58] Field of Search ..... 368/91-95

[56] References Cited

U.S. PATENT DOCUMENTS

| | | | |
|---|---|---|---|
| 3,501,911 | 3/1970 | Sjostrom | 368/91 |
| 4,267,588 | 5/1981 | Daniels | 368/91 |
| 4,332,096 | 6/1982 | Kohmer et al. | 368/91 |

*Primary Examiner*—Bernard Roskoski
*Attorney, Agent, or Firm*—Leon Gilden

[57] ABSTRACT

An apparatus is provided for enhanced viewing of an hour glass structure, wherein an annular table top mounts a transparent plate overlying an hour glass structure. The hour glass structure is pivotally mounted axially of the transparent plate, wherein the plate affords protection to the hour glass structure from debris, dirt, and the like. A digital clock is positioned on the table framework for providing comparative timing relative to the hour glass structure. The organization further includes in a modified configuration, a florescent illumination member mounted to the framework overlying the hour glass member, with the hour glass member further provided with a magnification lens formed in each base portion of each chamber. Luminescent particles are provided within the hour glass member, with the light in relation to the hour glass enhanced through each magnification lens and further wherein the particles provide enhanced viewing and positioning of relative volumetric supply of particles within each chamber of the hour glass member.

4 Claims, 3 Drawing Sheets

CLOCK APPARATUS

BACKGROUND OF THE INVENTION

1. Field of the Invention

The field of invention relates to clock apparatus, and more particularly pertains to a new and improved clock apparatus wherein the same provides for an hour glass member mounted in a protected orientation within a table framework for enhanced viewing thereof.

2. Description of the Prior Art

Various clock structure had been utilized in the prior art. The prior art has further provided for the use of hour glass members in presentation of elapsed time and accounting therefore. Examples of the prior art are set forth in U.S. Pat. No. 3,151,442 to Cullen, et al. wherein a clock is operatively coupled to a motorized carriage containing an hour glass, wherein the hour glass is rotated at predetermined time intervals.

U.S. Pat. No. 4,030,285 to Shetta sets forth an hour glass clock structure simulating operation of one or more hour glasses in an electronic matrix of lenses in an hour glass configuration.

U.S. Pat No. Des. 166,486; 248,542; and 300,725 are further examples of various hour glass configurations.

As such, it may be appreciated that there continues to be a need for a new and improved clock apparatus as set forth by the instant invention which addresses both the problems of ease of use as well as effectiveness inconstruction providing for an hour glass structure in a protected and unique relationship to provide enhance visual and education understanding of elapsed time in use of an hour glass structure.

SUMMARY OF THE INVENTION

In view of the foregoing disadvantages inherent in the known types of clock apparatus now present in the prior art, the present invention provides a clock apparatus wherein the same provides for an hour glass structure arranged for visual observation through a side or overlying orientation relative to a support structure for the hour glass member contained within the organization. As such, the general purpose of the present invention, which will be described subsequently in greater detail, is to provide a new and improved clock apparatus which has all the advantages of the prior art clock apparatus and none of the disadvantages.

To attain this, the present invention provides an apparatus with enhanced viewing of an hour glass structure, wherein an annular table top mounts a transparent plate overlying an hour glass structure. The hour glass structure is pivotally mounted axially of the transparent plate, wherein the plate affords protection to the hour glass structure from debris, dirt, and the like. A digital clock is positioned on the table framework for providing comparative timing relative to the hour glass structure. The organization further includes in a modified configuration, a florescent illumination member mounted to the framework overlying the hour glass member, with the hour glass member further provided with a magnification lens formed in each base portion of each chamber. Luminescent particles are provided within the hour glass member, with the light in relation to the hour glass enhanced through each magnification lens and further wherein the particles provide enhanced viewing and positioning of relative volumetric supply of particles within each chamber of the hour glass member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved clock apparatus which has all the advantages of the prior art clock apparatus and none of the disadvantages.

It is another object of the present invention to provide a new and improved clock apparatus which may be easily and efficiently manufactured and marketed.

It is a further object of the present invention to provide a new and improved clock apparatus which is of a durable and reliable construction.

An even further object of the present invention is to provide a new and improved clock apparatus which is susceptible of a low cost of manufacture with regard to both materials and labor, and which accordingly is the susceptible of low prices of sale to the consuming public, thereby making such clock apparatus econmically available to the buying public.

Still yet another object of the present invention is to provide a new and improved clock apparatus which provides in the apparatuses and methods of the prior art some of the advantages thereof, while simultaneously overcoming some of the disadvantages normally associated therewith.

Still another object of the present invention is to provide a new and improved clock apparatus wherein the same sets forth an hour glass structure arranged for enhanced visual observation of luminescent particles contained within the hour glass, with the hour glass formed with magnetic end lenses for enhances illumination of the particles by an overlying illumination member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
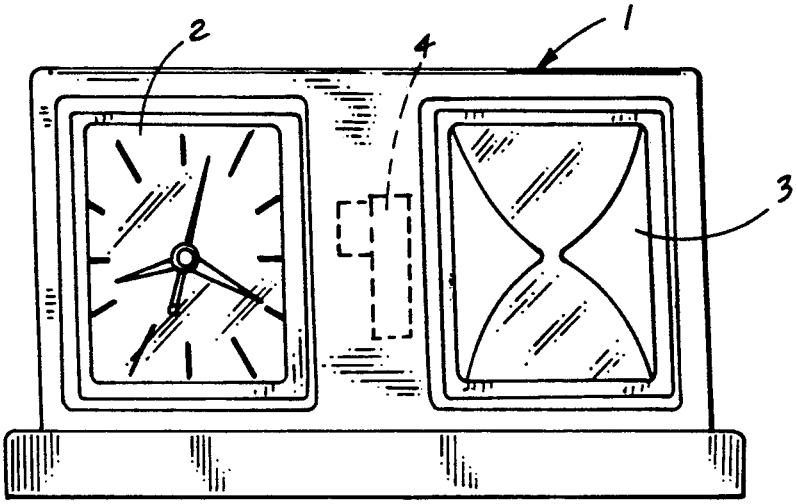
FIG. 1 is an orthographic side view, taken in elevation, of a prior art clock apparatus utilizing an hour glass member.
Figure 2:
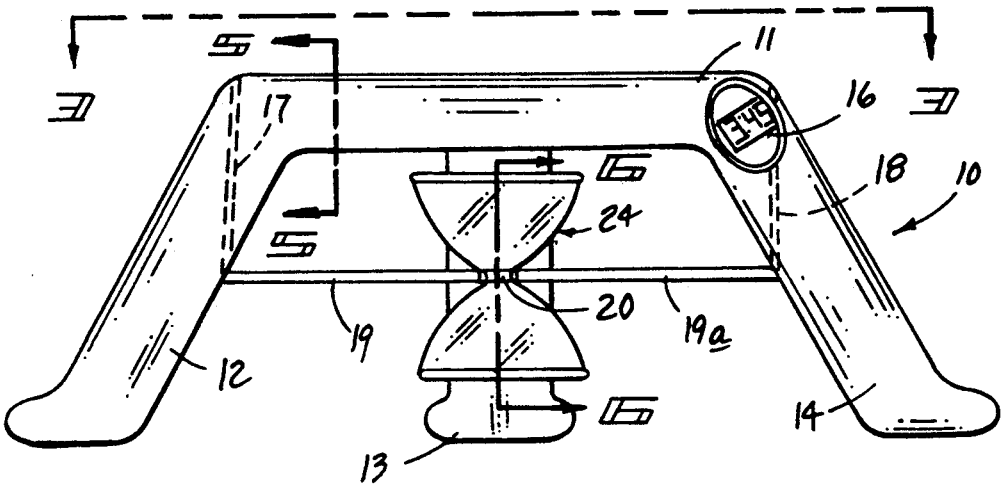
PRIOR ART FIG 2
FIG. 2 is an orthographic side view, taken in elevation. of the instant invention.
Figure 3:
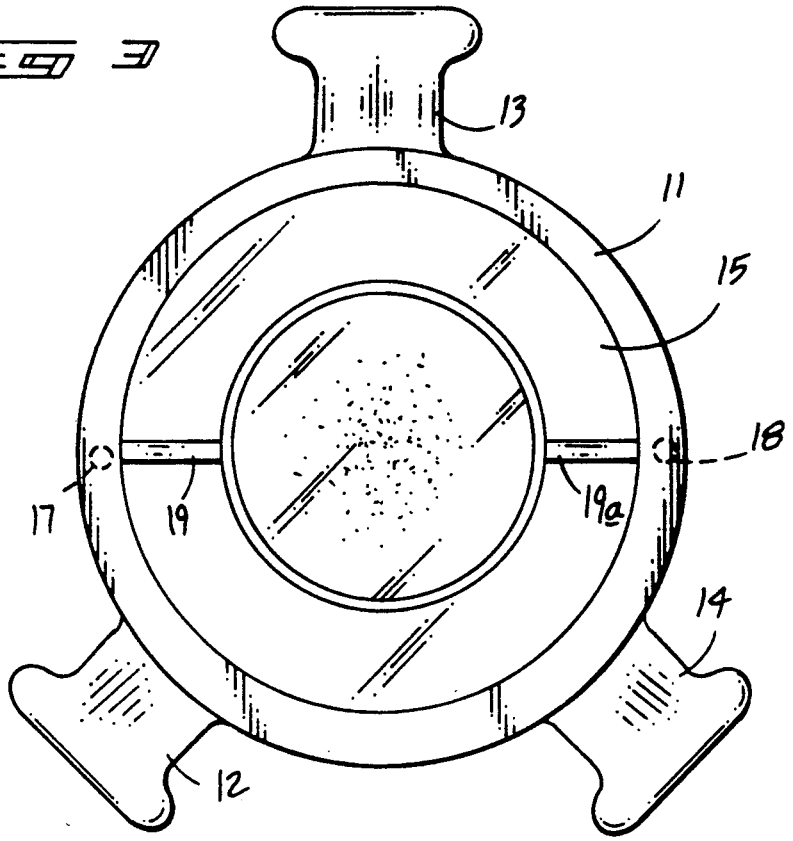
FIG. 3 is an orthographic top view of the instant invention.
Figure 4:
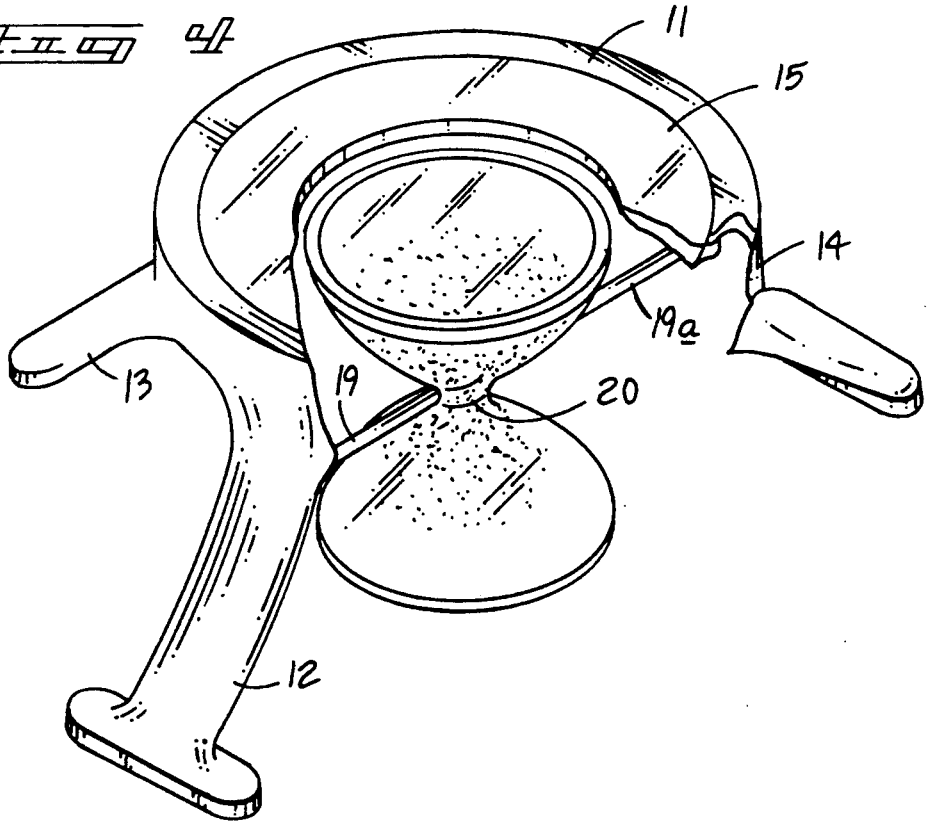
FIG. 4 is an isometric illustration, somewhat enlarged, setting forth the instant invention.

With reference now to the drawings, and in particular to FIGS. 1 to 6 thereof, a new and improved clock apparatus embodying the principles and concepts of the present invention and generally designated by the reference numeral 10 will be described.

FIG. 1 illustrates a prior art clock apparatus 1, wherein a conventional clock member 2 is cooperatively coupled to an hour structure 3 through a gear mechanism 4 to effect rotation of the hour glass member at predetermined intervals, in a manner as set forth in U.S. Pat. No. 3,151,442.

More specifically, the clock apparatus 10 of the instant invention essentially comprises a framework that includes an angular table top ring 11 horizontally disposed, with a first, second, and third leg 12, 13, and and 14 respectively directed downwardly and spaced sixty degrees apart relative to one another to defined support legs for the table top ring. The ring mounts a transparent plate 15 in a surrounding perimeter relationship. A digital clock 16 is mounted to the ring at a junction of the third leg relative to the ring to provide digital time relationship relative to operation of the associated hour glass member 24 mounted medially underlying the transparent plate 15. A first and second vertical support rod 17 are directed orthogonally downwardly relative to diametrically opposed positions on the ring underlying the ring, with a respective first and second horizontal support rod 19 and 19*a* mounted orthogonally to the lower terminal ends of the respective first and second vertical support rods. A circumferential transparent strap 20 is mounted in surrounding relationship relative to the trickle tube portion 27 of the hour glass member. The hour glass member itself is defined by a respective first and second chamber 25 and 26 respective containing a quantity of luminescent particles 30 therewithin. The liminescent particles are of a quantity defining a predetermined time interval in their gravitational descent from an upper to a lower chamber of the first and second chambers 25 and 26.

Figure 5:
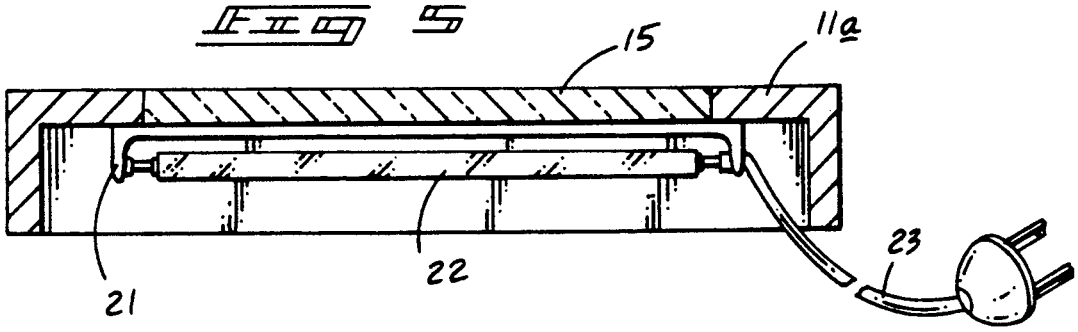
FIG. 5 is an orthographic cross-sectional illustration of a modified top ring support in cooperation with the illumination member utilized by the instant invention.
Figure 6:
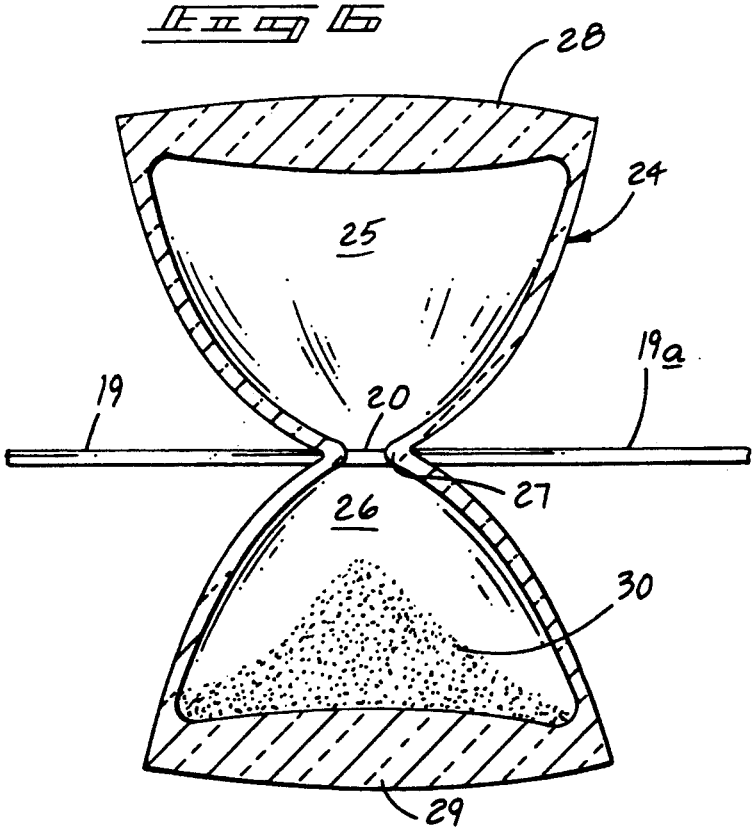
FIG. 6 is an orthographic side view of the hour glass structure utilized by the instant invention.

With reference to FIG. 5, a modified table top ring 11*a* includes a transparent "U"shaped florescent bulb support fixture 21 mounted overlying the hour glass member 24 between the transparent plate 15 and the hour glass member. A florescent bulb 22 is mounted within the transparent bulb support fixture 21, with an electrical supply cord 23 directed to the fixture to direct selective electrical energy to the florescent bulb member. The upper first chamber 25 includes a first a magnification lens base 28, with the second chamber 26 coaxially aligned underlying the first chamber 25, including a second magnification lens base 29. The magnification lens bases 28 and 29 enchance light directed interiorly of the hour glass member 24 to enhance visual presence of the luminescent particles 30 contained within the hour glass member. Further, the magnification lenses forming the bases of each of the first and second chambers 25 and 26 respectively enhance visual observation of each chamber when viewed through the transparent plate 15 to enhance visual observation and enjoyment of the hour glass in its gravitational directing of the luminescent particles 30 through the trickle tube 27.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A clock apparatus comprising, in combination, a support framework, the support framework including a table top ring, and a plurality of legs fixedly mounted to a bottom surface of the table top ring spaced apart a predetermined spacing relative to one another, and a clock member mounted within the famework at an intersection of the table ring and one of said legs, and an hour glass member including a first chamber and a second chamber, with the first and second chambers including a trickle tube positioned therebetween, with the first chamber, second chamber, and trickle tube coaxially aligned, and the hour glass member pivotally mounted medially underlying the table top ring, and including a transparent plate mounted within the table top ring overlying the hour glass member, with the hour glass member positioned medially and coaxially of the table top ring, and including a first vertical support rod and a second vertical support rod diametrically mounted relative to one another underlying the table top ring, and a first horizontal support rod fixedly and orthogonally mounted to a lower terminal end of the first vertical support rod, and a second horizontal support rod fixedly and orthogonally mounted to a lower terminal end of the second vertical support rod, with the first and second horizontal support rods coaxially aligned relative to one another, and a transparent circumferential strap mounted about the trickle tube of the hour glass member, and the transparent circumferential strap pivotally mounted to forward terminal ends and spaced medially of the first and second horizontal support rods.

2. An apparatus as set forth in claim 1 wherein the transparent plate includes an illumination source mounted underlying the transparent plate and secured to the annular table top ring, wherein the illumination source includes a "U" shape transparent florescent bulb support fixture and a florescent bulb mounted within the bulb support fixture.

3. An apparatus as set forth in claim 2 wherein the hour glass member includes a predetermined quantity of luminescent particles contained therewithin.

4. An apparatus as set forth in claim 3 wherein the first chamber of the hour glass member includes a first magnification lens base, and the second chamber of the hour glass member includes a second magnification lens base, wherein the first and second magnification lens bases are each arranged parallel relative to one another and coaxially aligned relative to the first and second chamber respectively to enhance magnification of light directed to the luminescent particles within the hour glass member.

* * * * *